United States Patent [19]

Achelpohl

[11] 4,181,345

[45] Jan. 1, 1980

[54] LIFTING TACKLE FOR FILLED SACKS

[75] Inventor: Fritz Achelpohl, Lengerich, Fed. Rep. of Germany

[73] Assignee: Windmöller & Hölscher, Lengerich, Fed. Rep. of Germany

[21] Appl. No.: 841,380

[22] Filed: Oct. 12, 1977

[30] Foreign Application Priority Data

Oct. 14, 1976 [DE] Fed. Rep. of Germany ..... 2646493

[51] Int. Cl.[2] ..... B66C 1/10

[52] U.S. Cl. ..... 294/103 R; 24/68 E; 24/196; 294/86 R

[58] Field of Search ..... 294/1 R, 67 B, 67 EA, 294/74, 83 A, 86 R, 103 R; 24/68 R, 68 E, 136 R, 136 K, 170, 171, 191, 193, 194, 196, 197; 224/50–52, 54

[56] References Cited

U.S. PATENT DOCUMENTS

| | | | |
|---|---|---|---|
| 1,325,422 | 12/1919 | Stuart | 24/136 K X |
| 1,962,846 | 6/1934 | St. Pierre | 24/193 |
| 2,327,139 | 8/1943 | Scott | 24/136 K X |
| 3,296,672 | 1/1967 | Knight | 24/193 |
| 3,606,439 | 9/1971 | Rutan | 294/74 |

FOREIGN PATENT DOCUMENTS

| | | | |
|---|---|---|---|
| 2607909 | 9/1976 | Fed. Rep. of Germany | 294/103 R |
| 2317216 | 7/1975 | France | 294/74 |

*Primary Examiner*—Johnny D. Cherry
*Attorney, Agent, or Firm*—Fleit & Jacobson

[57] ABSTRACT

A lifting device for filled sacks comprises a frame in which a pair of parallel clamping bars are mounted to be revolved in unison by a crank about a common horizontal axis parallel to and spaced from the longitudinal axes of the bars. One of the bars is individually rotatable about its own longitudinal axis and is displaceable towards and away from the other bar. The gathered top of a sack is introduced between the bars when these are separated and automatically becomes wrapped around the bars and clamped therebetween as the crank is turned, whereafter the sack can be lifted by raising the frame.

10 Claims, 7 Drawing Figures

LIFTING TACKLE FOR FILLED SACKS

The invention relates to an apparatus for lifting a filled sack, comprising a pair of clamping rods around which the gathered and flattened end of the sack is slung.

An apparatus of this kind known from U.S. Pat. No. 3,937,394 comprises a pair of substantially parallel clamping rods, one end of each clamping rod being bent and resiliently embracing the other rod and the other ends of the pair of clamping rods being in one piece to form a supporting device. To engage the end of the sack to be carried, the supporting device of the known apparatus is swung downwardly about an axis disposed parallel to the clamping rods and the end of the sack is introduced between the clamping rods and the bent ends of the clamping rods are brought over the respective other rod so that they embrace the rods. The supporting device is then lifted so that it swings upwardly and, on further lifting, the sack is carried by the apparatus by clamping the end of the sack that is slung about the clamping rods. The known apparatus has the disadvantage that, in order to introduce the end of the sack, it must be lifted out of the hook of the crane. In the case of large sacks requiring a heavy apparatus, this cannot be done by the operator because of the heavy body stresses. In addition, the clamping rods must be resiliently moved towards one another. The unavoidable forces required to press them apart cannot be applied by hand.

It is therefore the problem of the invention to provide an apparatus of this kind for lifting filled heavy sacks, which apparatus can be readily manipulated by the operator and can nevertheless carry the heavy weight without permanent deformation.

The problem is solved according to the invention in that the clamping rods are mounted in a supporting device to pivot about an axis which is parallel to and spaced from their longitudinal axes and one clamping rod is easily displaceable towards the other. By pivoting the clamping rods in a common mounting, the supporting device can remain on the crane hook so that this part of the work is easy for the operator. The displaceable mounting of one of the clamping rods permits the clamping rods to be strong in construction, i.e. not resilient. After moving the displaceable clamping rod away from the fixed one, the end of the sack is introduced between the two clamping rods and the pair of clamping rods is turned through about 360° about itself so that the movable clamping rod is first swung above the fixed clamping rod and, in a second stage, below same. When the hook of the crane is lifted, the movable clamping rod is displaced towards the fixed one by the end of the sack or by the weight of the sack so that the end of the sack swung about the pair of clamping rods by the rotation of about 300° is securely clamped between the two clamping rods and slipping out of the clamping engagement is impossible.

To release the lifting apparatus, it is sufficient to deposit the sack and to pivot the pair of clamping rods back through 360° about itself. On raising the hook of the crane from which the lifting apparatus is suspended, the end of the sack leaves the space between the clamping rods and the sack is free.

Preferably, the pair of clamping rods is connected to at least one crank so that the 360° pivotal motion can be readily executed.

In an embodiment of the invention, one clamping rod is secured at both ends to plates having grooves in which the movable clamping rod is mounted for easy displacement and loose rotation. In this way the movable clamping rod can turn about itself when approaching the fixed clamping rod and the end of the sack slung thereabout rolls along its surface so that the sacks are not additionally subjected to a load by friction.

In a further development of the invention, journals engaging in the grooves are provided at the ends of the movable clamping rod.

Pins may be secured to the plates and loosely rotatably mounted in a supporting device. The axes of the pins are preferably disposed parallel to the axis of the fixed clamping rod and form the pivot axis.

Preferably, the pins are disposed adjacent a line, namely above same, which connects the two clamping rods. This achieves as large a wrapping angle as possible for the movable clamping rod.

Further, the hand cranks may be secured to the pins, which ensures a simple construction for the apparatus.

An example of the invention is illustrated in the drawing and will now be described in more detail. In the drawings.

Figure 1:
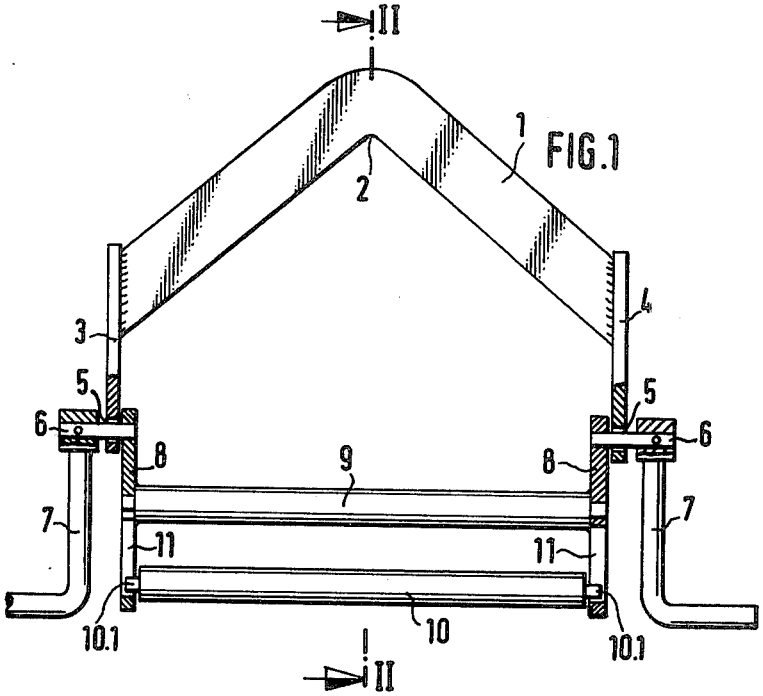
FIG. 1 is an elevation of the lifting apparatus.
Figure 2:
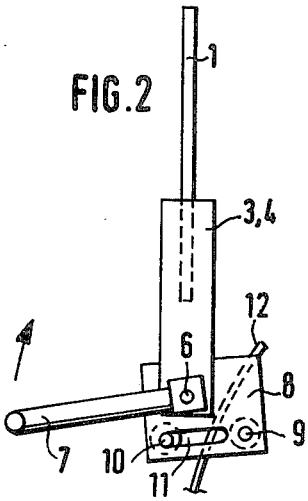
FIG. 2 is an end-side elevation of the apparatus.
Figure 3:
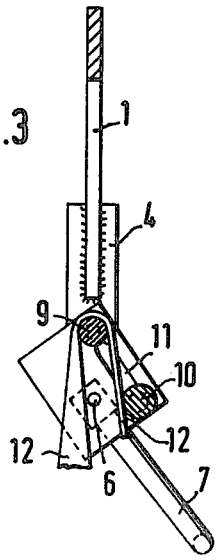
FIG. 3 is a section on the line II—II in FIG. 1 after half a revolution of the pair of clamping rods.
Figure 4:
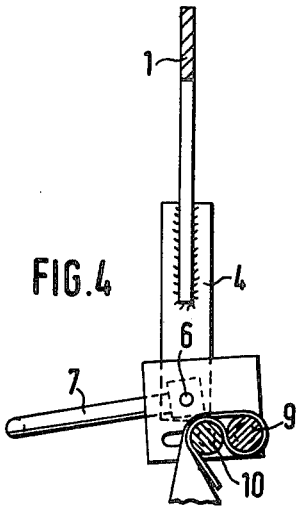
FIG. 4 is as FIG. 2 or FIG. 3 but after a complete turn of the pair of clamping rods.
Figure 5:
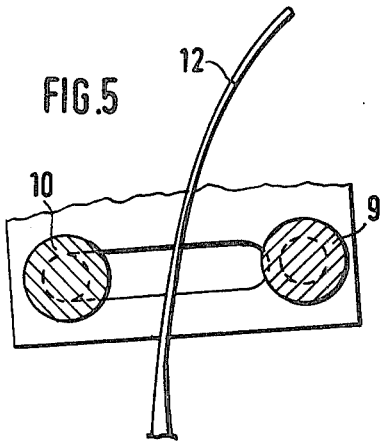
FIG. 5 is a section on the line II—II in FIG. 1 corresponding to FIG. 2 but to an enlarged scale.
Figure 6:
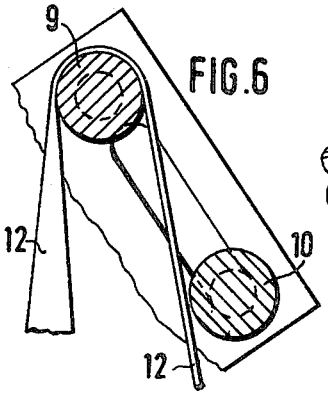
FIGS. 6 and 7 are enlarged representations corresponding to FIGS. 3 and 4.
Figure 7:
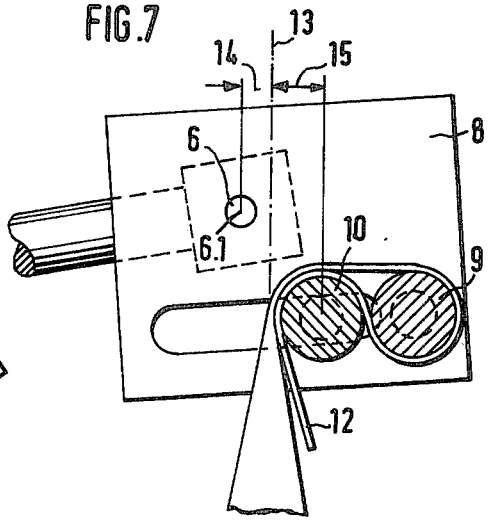

In the lifting apparatus shown in FIG. 1, the clamping rods and hand cranks are folded into the plane of the drawing. It comprises a supporting device 1 with a central suspension point 2 in which a hook (not shown) of a crane can engage. The supporting device 1 is fixed to plates 3, 4 which are provided with holes 5 in which pins 6 are loosely rotatable. The outwardly directed ends of the pins 6 are fixed to hand cranks 7 and the inwardly directed ends to plates 8. Between the plates 8 there are clamping rods 9, 10 of which the clamping rod 9 is welded at both ends to the plates. The clamping rod 10 has cylindrical journals 10.1 at both ends which are easily displaceable in grooves 11 of the plates 8. By reason of the cylindrical construction of the clamping rods, they can turn about themselves. The grooves 11 approach the clamping rod 9 so that the two clamping rods 9, 10 can touch each other. To introduce the upper end 12 of a sack to be lifted (not shown in further detail), the plates 8 are turned so that as wide an opening as possible is offered between the two clamping rods 9, 10 for the end 12 of the sack that is to be introduced from below and so that the connecting line between the two clamping rods 9, 10 assumes a substantially horizontal position. The pivotal axis 6.1 defined by the pins 6 is disposed above this connecting line. After introduction of the end 12 of the sack, the crank 7 is turned so that the displaceable clamping rod 10 is swung above the fixed clamping rod 9. FIGS. 3 and 6 show the position after swinging through 180° in the righthand sense. After further rotation in the same direction through a further 180° , the position shown in FIGS. 4 and 7 is reached. The movable clamping rod 10 moves towards the fixed clamping rod 9 under the tensile force of the sack and, in so doing, turns itself so that the end of the sack rolls on it. The end of the sack is clamped tight by being doubly slung about the clamping rod 10 and is also clamped between the two clamping rods 9, 10.

A vertical line 13 through the centre of gravity of the sack is disposed in the FIG. 7 terminal position between the pivotal axis 6.1 defined by the pins 6 and the movable clamping rod 10. The horizontal spacing between the vertical line 13 and the pivotal axis 6.1 is designated 14 and between the vertical line and the axis of the clamping rod 10 is designated 15. The spacings 14, 15 are set after reaching the position of equilibrium, which is determined by the force exerted on the pivotal axis 6.1, by the weight of the sack and by the torques produced by the spacings 14, 15. In the condition of equilibrium, the torque produced by the force exerted on the pivotal axis 6.1 and the spacing 14 is equal but opposite to the torque produced by the weight of the sack and the spacing 15.

By reason of the position reached in the final condition, stable and secure lifting of the sack is possible.

If the walls of the sack are thicker than shown in FIG. 7, the condition of equilibrium will be obtained even before the plates 8 have turned through 360° because in that case the spacing 15 will be larger than shown and the spacing 14 must become larger for balancing purposes.

I claim:

1. Apparatus for lifting a filled sack comprising a pair of clamping rods (9, 10) around which the gathered and flattened end of the sack is slung, the clamping rods being mounted in a supporting device (1) to pivot about an axis (6.1) which is parallel to and spaced from longitudinal axes of the clamping rods, one clamping rod (10) being easily displaceable towards the other (9), the other clamping rod (9) being secured at both ends to plates (8) having grooves (11) in which the displaceable clamping rod (10) is mounted for displacement and loose rotation, and pins (6) secured to the plates (8) and loosely rotatably mounted in said supporting device (1).

2. Apparatus according to claim 1, characterised in that the pair of clamping rods (9, 10) is pivotable about the pivot axis (6.1) by at least one crank (7).

3. Apparatus according to claim 2, characterised in that said at least one crank (7) is secured to the pins (6).

4. Apparatus according to claim 1, characterised in that journals (10.1) engaging in the grooves (11) are provided at the ends of the movable clamping rod (10).

5. Apparatus according to claim 1, characterised in that the axes of the pins (6) are disposed parallel to the axis of the other clamping rod (9) and form the pivot axis (6.1).

6. Apparatus according to claim 5, characterised in that the pins (6) are disposed adjacent an imaginary horizontal line, namely above same, which connects the two clamping rods (9, 10).

7. In an apparatus for lifting a filled sack having a pair of clamping rods around which a gathered and flattened end of the sack is slung, the improvement comprising:

means for defining a pivot axis;

a pair of plate members pivotable about the pivot axis, the pair of clamping rods being mounted in the plate members with their longitudinal axes parallel to and spaced from the pivot axis, one of said pair of clamping rods being displaceable towards the other; and means for rotating said plate members between a first position and a second position, the second position being angularly spaced from the first position by at least 300°, said clamping rods in said first position having their axes located in a substantially horizontal plane and being spaced apart to receive a gathered and flattened end of the sack, said one displaceable clamping rod being movable towards the other of said clamping rods during the rotation of said plate members between said first and said second positions so that said clamping rods clamp the end of the sack therebetween.

8. The improvement of claim 7 wherein said clamping rods are mounted in the plate members in such manner that a vertical line through the center of gravity of a filled sack is positioned between the pivot axis and the axes of said clamping rods when said clamping rods are in said second position.

9. A method of clamping a gathered and flattened end of a sack to be lifted comprising:

positioning the end of the sack between a pair of spaced apart clamping rods having longitudinal axes, the axes being located in a substantially horizontal plane and the clamping rods being mounted in rotatable plate members with one of the clamping rods being displaceable towards the other; and rotating the plate members through an angle greater than 300° so that the end of the sack is folded back onto the sack and so that the displaceable clamping rod moves toward the other clamping rod thereby clamping the sack between the clamping rods.

10. The method of claim 9 wherein the end of the sack when positioned between the spaced apart clamping rods passes in an upward direction and wherein the end of the sack is folded to extend in a downward direction by rotation of the plate members.

* * * * *